US005909091A

United States Patent [19]

Conway

[11] Patent Number: 5,909,091

[45] Date of Patent: Jun. 1, 1999

[54] DISCHARGE LAMP INCLUDING AN INTEGRAL CATHODE FALL INDICATOR

[75] Inventor: David W. Conway, Cedar Rapids, Iowa

[73] Assignee: Rockwell International, Costa Mesa, Calif.

[21] Appl. No.: 08/962,158

[22] Filed: Oct. 31, 1997

[51] Int. Cl.[6] ..... H01J 11/04

[52] U.S. Cl. ..... 315/358; 315/340; 313/619; 313/642

[58] Field of Search ..... 315/50, 112, 117, 315/358, 340; 313/632, 636, 637, 643, 619, 620, 642

[56] References Cited

U.S. PATENT DOCUMENTS

| | | | |
|---|---|---|---|
| 4,041,345 | 8/1977 | Sahni | 313/225 |
| 4,996,465 | 2/1991 | Uetsuki | 315/358 |
| 5,027,030 | 6/1991 | Bouchard et al. | 313/619 |
| 5,150,009 | 9/1992 | Kling et al. | 315/107 |
| 5,161,041 | 11/1992 | Abileah et al. | 359/40 |
| 5,523,655 | 6/1996 | Jennato et al. | 315/246 |
| 5,612,593 | 3/1997 | Olson | 315/117 |

*Primary Examiner*—Don Wong
*Assistant Examiner*—Haissa Philogene
*Attorney, Agent, or Firm*—Kyle Eppele; James P. O'Shaughnessy

[57] ABSTRACT

An active matrix liquid crystal display (AMLCD) system is for use in avionic applications. The system includes an integral cathode fall indicator. The indicator relies on a gas fill mixture to provide an orange glow when the cathode fall region has an abnormally high potential across it. During normal operation, the gas fill mixture provides a light blue glow. The gas mixture includes helium, neon, argon, krypton, and xenon.

5 Claims, 4 Drawing Sheets

DISCHARGE LAMP INCLUDING AN INTEGRAL CATHODE FALL INDICATOR

FIELD OF THE INVENTION

The present invention relates to lighting systems for avionic displays or liquid crystal displays. More particularly, the present invention relates to a fluorescent lamp having a fault indicator.

BACKGROUND OF THE INVENTION

Avionic displays require high reliability. Avionic displays, such as, active matrix liquid crystal displays (AMLCD), are utilized in military and commercial aircraft to present navigational, flight, and target information. Avionic displays typically require a back light source that is capable of producing wide dynamic luminance ranges, of providing long operational life, and of operating over a temperature range of −20° celsius (C.) to +90° (C.). The back light must produce appropriate luminance over diverse operating conditions, such as, in direct sunlight, at night, and in fog conditions.

As is known in the art, specialized fluorescent lamps are utilized to produce the luminescence in accordance with the high performance specifications of AMLCDs. These specialized fluorescent lamps used in avionic back-lighting applications can cost almost fifty times as much as commercially available fluorescent lamps for ordinary consumer applications. The specialized fluorescent lamp can be fabricated from a four-foot length of sodium-lime glass tubing. The lamp is hand-crafted into a five-bend serpentine lamp configuration. This configuration is necessary to obtain sufficient phosphor area for the demanding luminance requirements associated with readability of avionic displays over various lighting conditions. The fabrication of the specialized fluorescent lamp is labor-intensive and extremely expensive.

Additionally, the fluorescent lamp is often bonded to a lamp heat sink to ensure lamp reliability. Allowing the lamp to become over heated seriously jeopardizes the dependable operation of the lamp and reduces its operating life. The lamp is permanently attached to heat sink with a two-part thermally conductive silicon elastomer adhesive system.

Lamp heat sinks are necessary because back light sources for avionic displays must be passively cooled and yet be operational over a large temperature range. Therefore, lamp reliability is especially critical since lamp replacement is not economically feasible once the lamp is permanently bonded to the lamp heat sink.

The lamp and lamp heat sink are generally assembled within a rear modular chassis for top level assembly into the aircraft or other system. The top level assembly additionally makes lamp replacement impracticable due to disassembly labor costs.

Specialized conventional fluorescent lamps include a pair of filaments or cathode coils disposed at opposite ends of glass tubing. The glass tubing has an interior surface coated with a phosphor material and is filled with a gas mixture of argon and mercury. The cathode coils emit ions which travel from the cathode coil through a cathode fall region and to a positive column. The gas mixture produces a characteristic light blue glow throughout the lamp when the ions travel through it.

However, if the lamp driver or inverter produces insufficient output current and the filaments (e.g., cathodes) are not operating at sufficient temperature (e.g. too cold), the filaments do not produce enough thermionic emissions, and mercury ions can bombard the filaments. The bombardment of the filaments or cathode coils can sputter away the cathode oxide coating on the coils, thereby severely reducing the operating lifetime of the lamp. Heretofore, prior art fluorescent lamps and avionic displays have not provided any warning or indication of the deterioration of the cathode oxide coating. As stated above, this is particularly problematic because lamps are particularly difficult to replace once they have been installed in an avionic system.

Thus, there is a need for a lamp or light which provides an indicator of reduced lamp operating life. Further still, there is a need for an integral cathode fall indicator which indicates a voltage across a cathode fall region, thereby indicating proper operation of the fluorescent lamp.

SUMMARY OF THE INVENTION

The present invention relates generally to a fluorescent lamp for use in a back light application. The fluorescent lamp includes at least one cathode and a gas fill mixture including a majority share of neon and a minority share of argon. The argon provides a blue glow when an ionization potential across a cathode fall region is at least 14 volts, and the neon provides an orange glow when the ionization potential is at least 20 volts, thereby indicating deterioration of cathode emission material.

The present invention further relates to an avionic display system including a back light. The back light includes a tubing filled with a gas mixture. The gas mixture provides a first color in a cathode fall region in response to a first potential across the cathode fall region of the tubing. The gas mixture provides a second color in the cathode fall region in response to a second potential across the cathode fall region of the tubing. The second color indicates that the back light has a relatively short remaining lamp life.

The present invention still further relates to a fluorescent lamp having an integral cathode fall indicator. The fluorescent lamp includes a cathode, an at least three-bend light tubing, and a gas mixture. The tubing has a cathode fall region between the cathode and a positive column when a tube potential is across the tubing. The gas mixture is contained in the glass tubing and provides a first color in response to a first potential across the cathode fall region. The gas mixture provides a second color in response to a second potential across the cathode fall region. The second color indicates that a coating of the cathode is deteriorating.

In one exemplary aspect of the present invention, a gaseous discharge lamp contains an integral gaseous cathode fall indicator. The indicator provides a characteristic orange-red glow localized at each cathode when the voltage across the cathode fall region is greater than 16V. If the cathode fall region has a voltage of greater than 16V, the cathode coils are being deteriorated. The red-orange glow indicates deterioration of cathode emission material, which can cause short lamp life.

In accordance with another exemplary aspect, the gas fill mixture preferably comprises 1% helium, 76% neon, 2% argon, 20% krypton, and 1% xenon. The lamp is further filled with mercury vapor and sealed in a glass tube at 3.5 torr. The gas fill mixture provides a 20% increase in lumen radiation efficiency at 77° C. compared to a 100% argon-filled lamp or tube at the same power level. During normal operation, the lamp has a characteristic light blue glow at the cathode fall region.

BRIEF DESCRIPTION OF THE DRAWINGS

Preferred exemplary embodiments of the present invention will hereafter be described with reference to the accompanying drawings, wherein like numerals denote like elements, and.

DETAILED DESCRIPTION OF PREFERRED EXEMPLARY EMBODIMENTS

Figure 1:
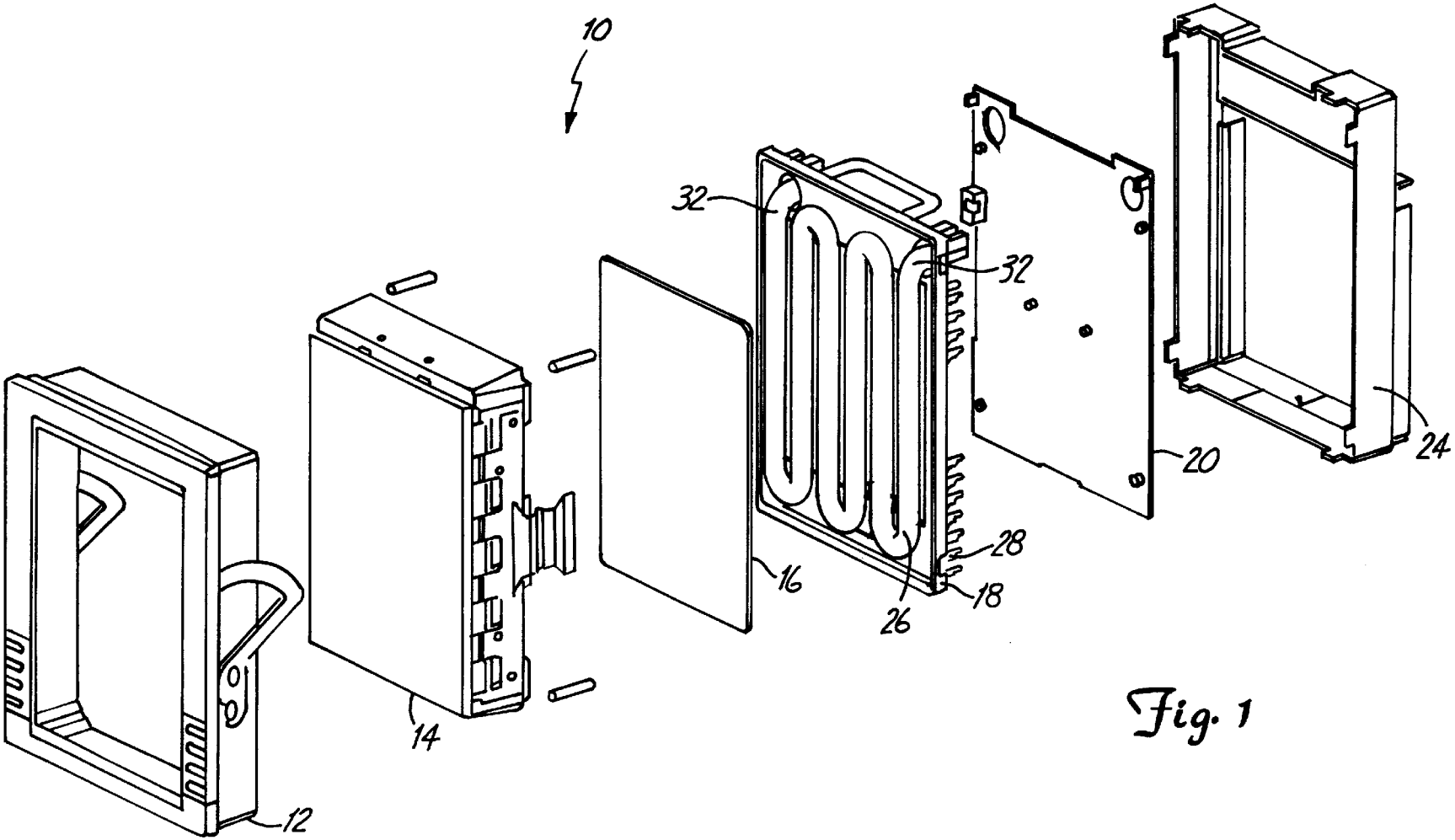
FIG. 1 is an exploded perspective view of a active matrix liquid crystal display (AMLCD) avionic display system including a display lamp in accordance with an exemplary embodiment of the present invention.

With reference to FIG. 1, an active matrix liquid crystal display (AMLCD) avionic display system 10 includes a bezel assembly 12, an LCD assembly 14, a diffuser 16, a back light assembly 18, an inverter 20, and a front chassis 24. Back light assembly 18 includes a fluorescent lamp 26 attached to a heat sink assembly 28. Heat sink assembly 28 is preferably bonded to lamp 26 by a two-part thermally conductive silicon elastomer adhesive system.

Fluorescent lamp 26 provides light through diffuser 16, LCD assembly 14, and bezel assembly 12 for viewing by a user. LCD assembly 14, diffuser 16, back light assembly 18, and inverter 20 are contained between bezel assembly 12 and front chassis 24. System 10 is disposed in a cockpit or other portion of an aircraft. Alternatively, system 10 can be utilized in other applications. The use of the rear modular chassis assembly of system 10 makes replacement costs associated with back light assembly 18 expensive.

Lamp 26 preferably includes five bends and is configured in a serpentine configuration. Lamp 26 includes a gas fill mixture comprised of 1% helium, 76% neon, 2% argon, 20% krypton, and 1% xenon. The fill gas mixture is mercury vapor sealed at a pressure of 3.5 torr in a soda-lime glass tube that is approximately four feet in length. Lamp 26 has a 20% increase in lumen radiation efficiency at 77° C. compared to a 100% argon-filled discharge lamp at the same input power level. Preferably, fluorescent material on the inner surface of lamp 26 is removed near cathode fall regions 274 (see FIG. 4) at ends 32 of lamp 26. During normal operation, lamp 26 preferably has a characteristic light blue glow.

Figure 2:
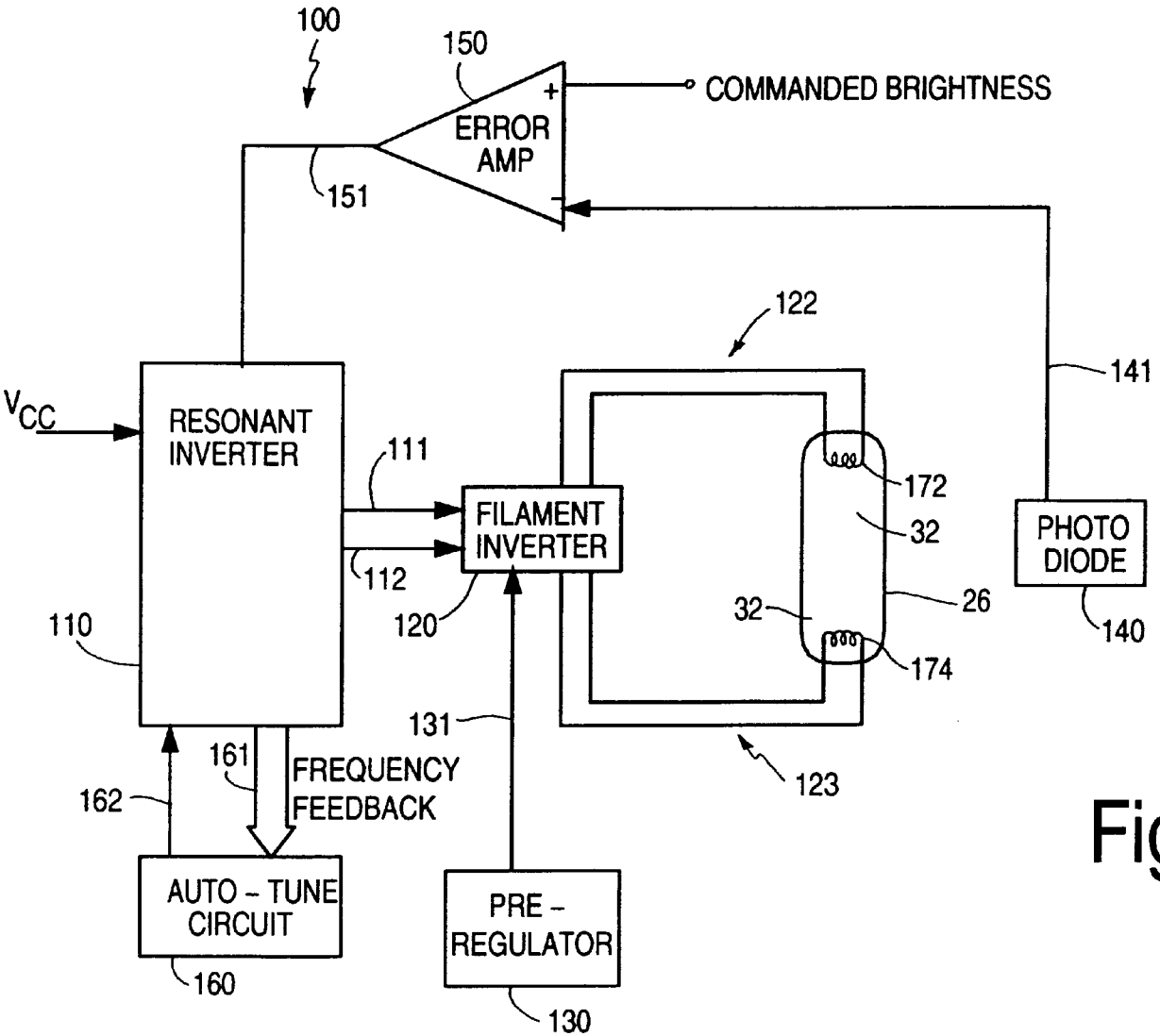
FIG. 2 is an electrical schematic block diagram of the avionic display system coupled to the display lamp illustrated in FIG. 1, in accordance with another exemplary embodiment of the present invention.

With reference to FIG. 2, a fluorescent lamp drive system or circuit 100 is coupled to filaments 172 and 174 at ends 32 of fluorescent tube or lamp 26. Fluorescent lamp drive system 100 includes a current fed or resonant inverter 110, a filament inverter 120, a pre-regulator 130, a photodiode 140, an error amplifier 150, and an auto-tune circuit 160. Fluorescent lamp drive circuit 100 is used to adjustably drive fluorescent lamp 26 over a wide luminance range. Fluorescent lamp drive circuit 100 also optimizes the efficiency of the energy transfer process as the impedance of lamp 26 changes. The operation of circuit 100 does not limit the scope of the invention. Circuit 100 is described to give an exemplary operational environment of lamp 26.

Resonant inverter 110 is coupled to voltage source Vcc, from which it receives power for conversion to a high voltage sinusoidal or near sinusoidal waveform that is used to drive cathode coils or filaments 172 and 174 of lamp 26. Resonant inverter 110 is also coupled to output 151 of error amplifier 150, to filament inverter 120 through resonant inverter outputs 111 and 112, and to auto-tune circuit 160 through frequency feedback 161 and auto-tune output 162. Filament inverter 120 is coupled to, and receives inputs from, resonant inverter 110 and pre-regulator 130. Filament inverter 120 is also coupled to filaments 172 and 174 of lamp 26 through filament inverter outputs 122 and 123, respectively. Filament inverter 120 drives lamp 26 with a low voltage waveform having a sufficient voltage magnitude such that filaments 172 and 174 of lamp 26 are maintained in an excited state and the gases inside of lamp 26 are not allowed to extinguish.

Photodiode 140 is in optical communication with lamp 26. Output 141 of photodiode 140 is coupled to the negative input of error amplifier 150. The positive input of error amplifier 150 is coupled to a Commanded Brightness input signal. Output 151 of error amplifier 150 is provided to resonant inverter 110 to control the amplitude of the high voltage waveform, and thereby to control the luminance of lamp 26.

Resonant inverter 110 is of the type known in the art which receives DC input voltage Vcc and provides a high voltage waveform at or across outputs 111 and 112. DC input voltage Vcc can be any of a wide range of voltages. However, in the preferred embodiment, DC input voltage Vcc varies between about 18 volts and about 32 volts. As discussed below in greater detail, the amplitude of the waveform at or across outputs 111 and 112 can be adjusted over a wide range (100 volts to 2.2 Kilovolts) to control the luminance of fluorescent lamp 26, but will typically be between about 250 volts and 400 volts peak-to-peak at a frequency of approximately 58 kilohertz (KHz). The frequency of the waveform can also vary due to factors, such, as, changes in the impedance of lamp 26.

Filament inverter 120 is preferably a driven square waveform inverter. Filament inverter 120 receives a DC input voltage of between about 5 volts and 8 volts from output 131 of pre-regulator 130 and provides a square wave of approximately the same amplitude at filament inverter outputs 122 and 123. The low voltage waveform provided by filament inverter 120 on outputs 122 and 123 has a frequency which is approximately one-half that of the high voltage waveform. The low voltage waveform is used to warm filaments (a.k.a. cathode coils) 172 and 174 and to maintain the filaments and the gases of lamp 26 in an excited state. Thus, the gases in lamp 26 are kept from extinguishing. As discussed below in greater detail, this eliminates the need to repeatedly use high voltage pulses to strike the arc of the lamp, as is required in at least some prior art dimmable lamp drive systems. Consequently, the useful lives of both lamp 26 and components of fluorescent lamp drive system 100 are extended. The high voltage waveform received by filament inverter 120 from resonant inverter 110 on outputs 111 and 112 is superimposed on the low voltage waveform on filament inverter outputs 122 and 123 using a double hot spot connection.

Photodiode 140 is of the type well-known in the art which provides a voltage output having a magnitude dependent upon the luminance level of lamp 26. The Commanded Brightness signal is a voltage signal controlled by the user or by a separate system or device to achieve a desired luminance from lamp 26. The voltage of the Commanded Brightness input has a predetermined relationship to the voltage output of photodiode 140 when lamp 26 is operating at the corresponding desired luminance. Error amplifier 150 is a conventional operational amplifier which provides an output voltage at output 151 dependent upon a difference in voltage between the Commanded Brightness signal and the output of the photodiode. The output voltage of error amplifier 150 is used by resonant inverter 110 to control the amplitude of the sinusoidal waveform provided to filament inverter 120 for driving lamp 26.

Auto-tune circuit 160 receives frequency feedback signal 161 from resonant inverter 110. Frequency feedback signal 161 is indicative of occurrences of zero crossings of the high voltage waveform generated by resonant inverter 110. Using frequency feedback 161, auto-tune circuit 160 detects occurrences of zero crossings of the high voltage waveform and generates an output signal on auto-tune output 162. The auto-tune circuit output signal is used by resonant inverter 110 to optimize the efficiency of the conversion of power from DC input voltage Vcc to the high voltage waveform used to drive the filaments of lamp 26.

Figure 3:
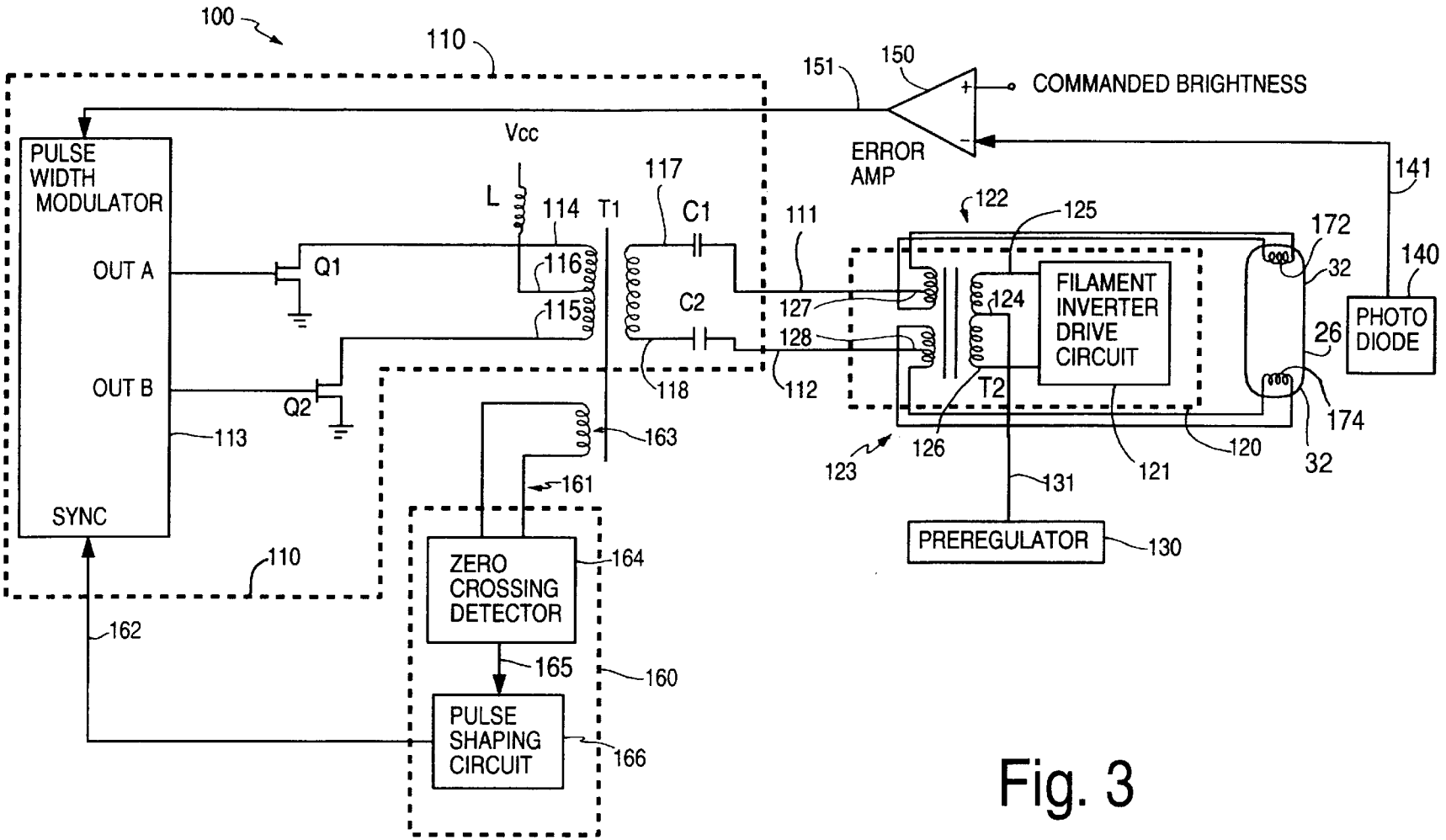
FIG. 3 is a more detailed electrical schematic diagram of the avionic display system illustrated in FIG. 2.

FIG. 3 is a schematic diagram illustrating one preferred embodiment of fluorescent lamp drive system or circuit 100 in greater detail. Resonant inverter 110 includes pulse width modulator 113, transistors or semiconductor switches Q1 and Q2, inductor L, transformer T1, and capacitors C1 and C2. DC voltage Vcc is coupled to center tap connection 116 of transformer T1 through inductor L. Pulse width modulator outputs OUT A and OUT B are coupled to the control electrodes of transistors Q1 and Q2, respectively, for controlling conduction of the transistors. The drains of transistors Q1 and Q2 are respectively coupled to inputs or connections 114 and 115 at the primary side of transformer T1. Connections 117 and 118 to the secondary side of transformer T1 are coupled, each through the respective one of capacitors C1 and C2, to outputs 111 and 112 of resonant inverter 110.

When transistor Q1 is conducting, a current path is formed from DC voltage source Vcc, through a first portion of transformer T1, to transistor Q1. When transistor Q2 is conducting, a second current path is formed from DC voltage source Vcc, through a second portion of transformer T1, to transistor Q2. Pulse width modulator 113 uses control signals (sometimes referred to as a gate voltage waveform) at OUT A and OUT B to alternate conduction periods of transistors Q1 and Q2 such that both are not conducting at the same time. The result is that an approximately square wave current waveform is produced in the primary side of transformer T1. This, in turn, results in the production of the high voltage waveform at the secondary side of transformer T1 and at outputs 111 and 112.

Filament inverter 120 includes transformer T2 and filament inverter drive circuit 121. Output 131 of pre-regulator 130 is coupled to center tap connection 124 of the primary side of transformer T2. Filament inverter drive circuit 121 is coupled to first and second connections 125 and 126 of the primary side of transformer T2. Filament inverter drive circuit 121 performs a function similar to transistors Q1 and Q2 of resonant inverter 110. Filament inverter drive circuit 121 alternates the conduction path from the DC voltage source provided by pre-regulator 130 such that a low voltage drive waveform is generated at the primary windings of transformer T2. The winding ratio of transformer T2 is preferably close to 1:1 so that low voltage waveforms are also generated at connections or outputs 122 and 123 of the secondary of transformer T2. The low voltage waveforms drive filaments 172 and 174 to maintain the gases of lamp 26 in an excited or non-extinguished state. Outputs 111 and 112 of resonant inverter 110 are coupled to center taps 127 and 128, respectively, on the secondary of transformer T2 so that the high voltage waveform is superimposed upon the low voltage waveform at outputs 122 and 123 and, thus, across filaments 172 and 174.

Auto-tune circuit 160 includes zero crossing detector 164 and pulse shaping circuit 166. Input 161 to zero crossing detector 164 is coupled to "tickler" or tertiary windings 163 on transformer T1. From the waveforms monitored at input 161, zero crossing detector 164 can detect the time at which the high voltage waveform generated by resonant inverter 110 has a zero crossing. This is consequently indicative of zero crossings of the tube or lamp voltage waveform. Output 165 of zero crossing detector 164 is indicative of the occurrence of a zero crossing. Pulse shaping circuit 166 can be any of a variety of well-known circuits designed to condition the output of zero crossing detector 164 to meet the requirements of pulse width modulator 113. Output 162 of pulse shaping circuit 166 is therefore a synchronization signal, of appropriate pulse width and height, which is indicative of the concurrent or recent realization of a zero crossing of the high voltage waveform generated by resonant inverter 110. Resonant inverter 110 uses output 162 of auto-tune circuit 160 to control the conduction of transistors Q1 and Q2 such that they can begin their respective conduction cycles at approximately the same time as a zero crossing of the high voltage waveform.

In operation, fluorescent lamp drive system 100 illustrated in FIGS. 2 and 3 functions generally as follows. Initially, the lamp is powered down and the output of photodiode 140 is correspondingly high. When the Commanded Brightness signal is first applied, the output of error amplifier 150 has a value which causes pulse width modulator 113 to drive transistors Q1 and Q2 at their maximum duty cycle. This causes the voltage generated at outputs 111 and 112 of resonant inverter 110 to ramp up very quickly. The resulting high voltage pulse is transferred through filament inverter 120 to filaments 172 and 174 to strike the arc of lamp 26. As the output luminance of lamp 26 increases, the feedback loop causes resonant inverter 110 to lessen the duty cycle of transistors Q1 and Q2 to clamp down the amplitude of the high voltage waveform to a level corresponding to the desired luminance.

After generation of the high voltage pulse to strike the arc and place the filaments and gases of the lamp 26 into an excited state, filament inverter 120 prevents the gases from extinguishing over a prolonged period of time by providing the low voltage waveform on outputs 122 and 123 to drive filaments 172 and 174, respectively. Through center taps 127 and 128 of transformer T2, the high voltage waveform superimposes onto outputs 122 an 123 of transformer T2 and, thereby, drives filaments 172 and 174. The photodiode and error amplifier feedback is maintained to keep the actual luminance intensity approximately equal to the desired luminance intensity. If a change in conditions causes the actual luminance to increase or decrease, the duty cycles of Q1 and Q2 are controlled accordingly to decrease or increase the amplitude of the high voltage waveform and thereby to decrease or to increase the actual luminance. Such adjustments are typically necessary when, for example, the magnitude of DC input voltage Vcc increases or decreases.

While filament inverter 120 prevents the gases of lamp 26 from extinguishing and resonant inverter 110 and its associated feedback control the luminance of lamp 26, auto-tune circuit 160 synchronizes circuit 100 for the particular impedance of lamp 26. As the impedance of lamp 26 changes with temperature, the frequency of the high voltage waveform used to drive the lamp typically will change as well. Without auto-tune circuit 160, transistors Q1 and Q2 would be switched on during some intermediate point of the high voltage waveform cycle. This would result in inefficient transfer of energy to lamp 26. By synchronizing the conduction times of Q1 and Q2 to begin only at the corresponding zero crossings of the high voltage waveform, power transfer efficiency is optimized.

Figure 4:
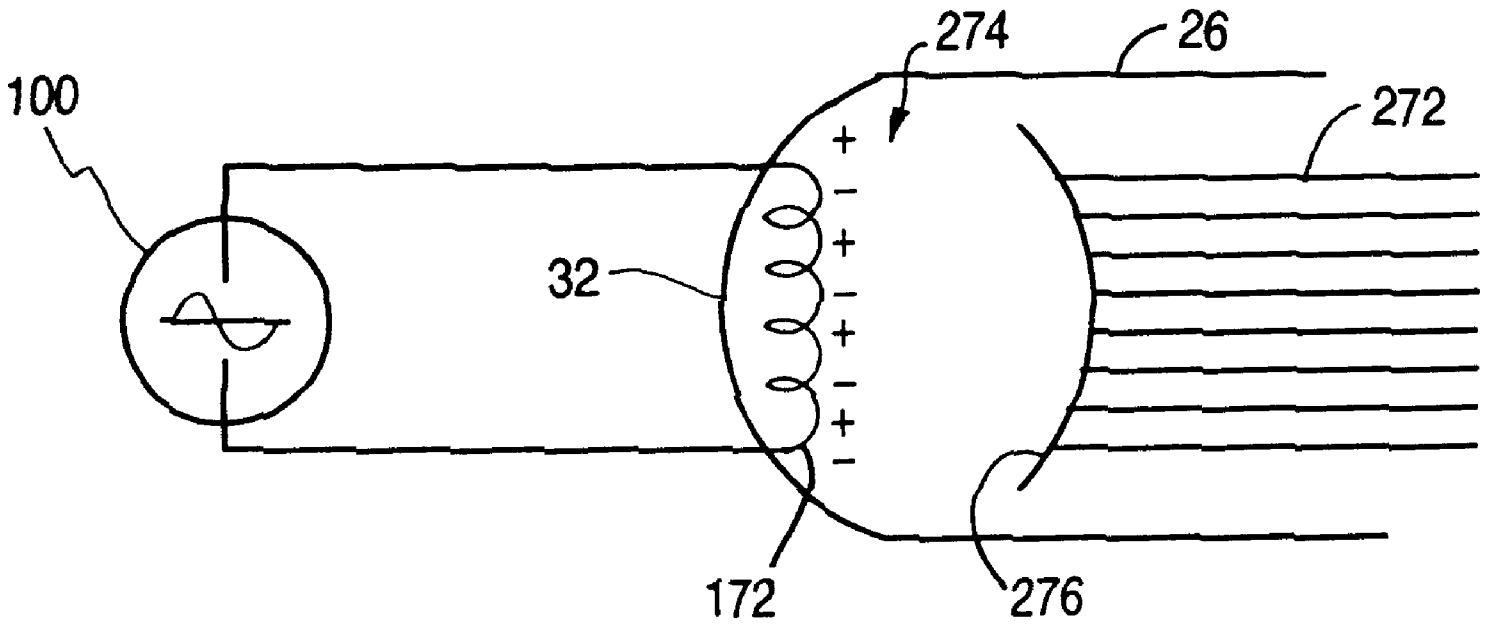
FIG. 4 is a more detailed schematic illustration of a portion of the display lamp illustrated in FIG. 1 showing a cathode fall region.

With reference to FIG. 4, a partial view of lamp 26 which is receiving the high voltage waveform from circuit 100 includes filament 172, lamp discharge column 272, and a cathode fall region 274. Cathode fall region 274 is a term recognized in the art representing the distance between a beginning 276 of evenly distributed positive column 272 and filament 172 (e.g., during a half cycle of the display signal). Lamp 26 also includes a cathode fall region between filament 174 and positive column 272 when lamp 26 is appropriately biased in the opposite direction to the direction shown in FIG. 4. Filaments 112 and 174 are coated with an oxide coating (e.g., an emission coating material).

Lamp 26 advantageously does not contain fluorescent material on its inner surface in cathode fall region 274. Cathode fall region 274 has a characteristic light blue glow indicating reliable operation when the voltage across region 274 is approximately 16 volts. When a voltage across region 274 is approximately 16 volts, argon in the fill gas mixture is ionized (e.g. argon has an ionization potential of 15.76 volts) and provides the light blue glow.

In contrast, if the potential across cathode fall region 274 is greater than 16 volts, the neon in the fill gas mixture is ionized and provides a characteristic orange glow (e.g. the ionization potential of neon is 21.56 volts). The characteristic orange glow indicates that the voltage across cathode fall region 274 is greater than 16 volts, which in turn indicates that emission coating materials on filament 172 are deteriorating, thereby shortening the life of lamp 26.

The fill gas mixture in lamp 26 also includes a small percentage of helium so that a red glow begins when the potential across the cathode fall region 274 reaches over 24 volts (e.g. the ionization potential of helium is 24.58 volts). The orange-red glow indicates excessive electrode drop or potential across cathode fall region 274. The gas fill mixture does not change the chromaticity of the light produced by lamp 26 during normal operation. Krypton provides a 20% increase in radiation efficiency. Xenon is added to reduce the starting voltages at low ambient temperatures because xenon has nearly the same ionization potential as mercury but will not condense at 0° C. As lamp 26 warms up, the mercury vapor becomes the predominant current carrier. The xenon component does not provide any adverse secondary effects to performance of lamp 26.

By providing an integral cathode fall indicator at cathode region 274 by utilizing an appropriate gas mixture, lamp 26 may be tested in production and screened to remove lamps 26 which do not have proper operation. Accordingly, cost may be saved as only lamps 26 with long operating lives are shipped to customers. This procedure ensures delivery of a reliable product where it is economically impracticable to change lamps 26 once installed in avionic applications.

Additionally, the integral cathode fall indication is advantageous for testing dim mode operation. System 10 must operate in dim modes during low light environment. The dim modes can cause circuit 100 to provide an excessive electrode drop to lamp 26 if lamp 26 is not compatible with circuit 100. If this occurs, mercury ions migrate to one end 32 of lamp 26 and damage filament 172 or 174 on the one end 32. When this happens, the potential across region 274 is increased, and lamp 24 has a red-orange glow which indicates there is a problem with the dim mode operation. Thus, the present invention can also be used to test dim mode operation.

It is understood that, while the detailed drawings, specific examples, and particular dimensions given describe preferred exemplary embodiments of the present invention, they are for the purpose of illustration only. The method and apparatus of the present invention is not limited to the precise details disclosed. For example, although specific mixtures are disclosed other mixtures are possible. Various changes can be made to the details disclosed without depleting from the spirit of the invention defined by the following claims.

What is claimed is:

1. A fluorescent lamp for use in back light applications, the fluorescent lamp comprising:

at least one cathode;

a fill gas mixture including 76 percent Neon, 20 percent Krypton, 2 percent Argon, 1 percent Xenon, and 1 percent Helium whereby, the Argon provides a blue glow when an ionization potential across a cathode fall region is at least 14 volts and the Neon Provides an orange glow when the ionization potential is at least 20 volts, thereby indicating deterioration of cathode emission material; and the Helium provides an enhanced orange glow with a red color.

2. The fluorescent lamp of claim 1, wherein the mixture is 20 percent Krypton, 1 percent Helium, 76 percent Neon, 2 percent Argon, and 1 percent Xenon and whereby the mixture provides a 20% increase in lumen radiation efficiency over a 100 percent Argon mixture.

3. An avionic display system, comprising a back light, the back light including a tubing filled with a gas mixture of 20 percent Krypton, 1 percent Helium, 76 percent Neon, 2 percent Argon, and 1 percent Xenon, the gas mixture providing a first color of blue glow in a cathode fall region in response to a first potential across the cathode fall region of the tubing, the gas mixture providing a second color of orange-red glow in the cathode fall region in response to a second potential across the cathode fall region of the tubing, whereby the second color indicates that the back light has a relatively short remaining lamp life.

4. The fluorescent lamp having an integral cathode fall indicator, the fluorescent lamp comprising:

a cathode;

an at least three-bend light tubing, the tubing having a cathode fall region between the cathode and a positive column when a tube potential is across the tubing; and a gas fill mixture of approximately 20 percent Krypton, 1 percent Helium, 76 percent Neon, 2 percent Argon, and 1 percent Xenon contained in the light tubing, the gas mixture providing a first color in response to a first potential across the cathode fall region, the gas mixture providing a second color in response to a second potential across the cathode fall region, whereby the second color indicates that a coating of the cathode is deteriorating.

5. The fluorescent lamp of claim 4, wherein the mixture is 20 percent Krypton, 1 percent Helium, 76 percent Neon, 2 Argon, and 1 percent Xenon and whereby the mixture provides a 20% increase in lumen radiation efficiency over a 100 percent Argon mixture.

* * * * *